US006253494B1

(12) United States Patent
Shaffron

(10) Patent No.: US 6,253,494 B1
(45) Date of Patent: Jul. 3, 2001

(54) SCREEN-TO-STAGE AND STAGE-TO-SCREEN SEAMLESS TRANSITION THEATER

(76) Inventor: Darlene D. Shaffron, 36 Wooded Run Dr., Dillsburg, PA (US) 17019

( * ) Notice: Subject to any disclaimer, the term of this patent is extended or adjusted under 35 U.S.C. 154(b) by 0 days.

(21) Appl. No.: 09/420,389

(22) Filed: Oct. 19, 1999

Related U.S. Application Data

(60) Provisional application No. 60/104,781, filed on Oct. 19, 1998.

(51) Int. Cl.[7] ..... E04H 3/26
(52) U.S. Cl. ..... 52/7; 52/64
(58) Field of Search ..... 52/64, 66, 65, 52/6, 7

(56) References Cited

U.S. PATENT DOCUMENTS

| | | | | |
|---|---|---|---|---|
| 258,539 | * | 5/1882 | Needham | 52/7 |
| 612,836 | | 10/1898 | Ellis . | |
| 1,045,398 | * | 11/1912 | Hagen | 52/7 |
| 1,542,299 | * | 6/1925 | Hasait | 52/7 |
| 1,544,150 | * | 6/1925 | Hasait | 52/7 X |
| 1,616,198 | * | 2/1927 | Partington | 52/7 |
| 3,399,887 | * | 9/1968 | Altier | 52/7 X |
| 4,885,878 | | 12/1989 | Wuu . | |
| 4,962,420 | * | 10/1990 | Judenich | 52/6 X |
| 5,313,276 | | 5/1994 | Taaffe . | |
| 5,365,704 | * | 11/1994 | Ray | 52/7 X |
| 5,469,669 | | 11/1995 | Alter . | |
| 5,778,603 | * | 7/1998 | Reppas | 52/66 |
| 5,850,712 | * | 12/1998 | Errato | 52/6 X |
| 5,964,064 | * | 10/1999 | Goddard et al. | 52/6 X |

FOREIGN PATENT DOCUMENTS

779554 * 11/1980 (SU) .

* cited by examiner

*Primary Examiner*—Peter M. Cuomo
*Assistant Examiner*—Hanh V. Tran
(74) *Attorney, Agent, or Firm*—Ellis Venable & Busam LLP

(57) ABSTRACT

A multi-entertainment platform that combines the elements of a motion picture with the elements of a live performance using a theatre construction. An upper stage and a motion picture viewing screen arrangement allows the audience to experience continuous uninterrupted entertainment on screen and on stage with seamless transitions between stage to screen and screen to stage.

14 Claims, 10 Drawing Sheets

SCREEN-TO-STAGE AND STAGE-TO-SCREEN SEAMLESS TRANSITION THEATER

This application claims the benefit of U.S. Provisional Application No. 60/104,781 filed on Oct. 19, 1998.

BACKGROUND OF THE INVENTION

1. Field of the Invention

The present invention relates generally to theater and stage design, and more particularly, to a novel and unique rotating theater and rotating stage design that produces seamless screen to stage and stage to screen transitions.

2. Descritpion of Related Art

The performing arts have long been a cornerstone of society. Throughout history, the performing arts have played an important role in the expression of a society's values, virtues, and vices. With such a crucial and central role in society, the performing arts have become a part of the essential fabric of a society. Before the advent of motion pictures, the theater experience consisted of live performances. Live theater is exciting and vibrant where the enthusiasm of the performers and the excitement of the performance is easily felt by the audience. Live theater is a richly rewarding experience for both young and old.

With the advent of motion pictures, new vistas and avenues of opportunities and new and different means and forms of expression became available that heretofore simply did not exist. Cinema provides the performing artist and the many other creative people involved with the performing arts with a wonderful vehicle with which to capture and express all the joys and all the sorrows of the human experience. Movies provide an audience with aspects of a performance not readily available to live theater or with aspects not possible with a live performance, for example, breathtaking panoramic views, action sequences that require large areas and/or large numbers of people, the passionate and emotional closeups, and of course, the spine-tingling cinematic special effects. Movies provide elements of excitement and entertainment simply not available to live theater. The excitement of watching a "Starship" warp through space or a person dangling perilously over a cliff thousands of feet in the air or feeling the emotional intimacy provided by a closeup view of an actor's face which reveals all the anguish or happiness of an emotion so stirringly captured in the actor's eyes cannot be achieved in a live performance.

Both live theater and motion pictures have their own unique gifts and qualities and their own special offerings. Each art form has its own special attributes that cannot be duplicated by the other. Each has its own elements of drama and excitement. Each provides its audience with a memorable experience and with a desire to come back for more again and again. Each art form is alive and well, in fact, each is thriving as is evidence by the enormous financial success of many movies and plays.

The related art describes a few innovations designed to enhance the entertainment experience of the performing arts patron. For example, an advanced state of the art movie theater whose building is formed in the shape of a spherical geodesic dome is described in U.S. Pat. No. 4,885,878 issued on Dec. 12, 1989 to G. Wuu. The building for the theater has a dome-like spherical configuration that is formed of geodesic triangular panels. The inner wall surface of the building functions as a curved motion picture screen surface and provides at least 300 degrees of an arc for projecting the movie. A platform within the dome is spaced upwardly a predetermined height from the bottom surface of the building. An electronic control system is used to tilt the platform upwardly and downwardly in any direction about its vertical axis in all 360 degrees. The electronic system is coordinated with the motion picture to be viewed to give the viewer a vivid sensation of seeing and feeling the action in a story as if being there.

An audiovisual display system for displaying three dimensional images that includes an image source for projecting an image in a predetermined direction is described in U.S. Pat. No. 5,313,276 issued on May 17, 1994 to K. Taaffe. A stage contained within the audiovisual display system provides a setting for the video image. The audiovisual display system displays three dimensional images along a line of sight to be viewed by a viewer. A transparent screen is disposed between the predetermined direction of the video image and the stage and is oriented at an angle less than 90 degrees to the line of sight and less than 90 degrees from the predetermined direction so that a viewer is able to view the stage and the image projected on the transparent screen so that the image appears to be positioned on the stage to the viewer.

A permanently fixed theater construction comprising a ground level lobby and a projection screen that are at opposite ends of the construction is described in U.S. Pat. No. 5,469,669 issued on Nov. 28, 1995 to L. Alter. A seating region on a support floor is angled downwardly from the lobby into a pit towards the projection screen. An entrance to and an exit from the seating region are both provided at the floor level through the lobby and there is a projection room with a projector in the lobby. The projection room includes a projection window above the floor level of the lobby facing the projection screen and the projector itself is movable from a first set up and maintenance position at the floor level to a second operating position level with the projection window. The projector when moved to the operating position projects a large format film to the screen.

None of the above inventions and patents, taken either singly or in combination, is seen to describe the instant invention as claimed. The prior art does not describe any entertainment platform as innovative and novel as the multi-entertainment or "Multex" platform of the present invention. The present invention combines the best of both cinema and live theater into a single enormously entertaining and engaging entertainment platform. There clearly exists the unfulfilled need for an entertainment platform that combines the best of both worlds.

SUMMARY OF THE INVENTION

Accordingly, it is a principal object of the invention to provide a stage and motion picture screen arrangement that creates seamless transitions from screen to stage and from stage to screen. It is another object of the invention to provide a novel and innovative form of entertainment that combines both the key elements of a motion picture and a live performance into a single entertainment experience.

It is a further object of the invention to provide a theater design that utilizes the unique features and characteristics of multi-entertainment.

Still another object of the invention is to provide a form of entertainment whereby the transition from screen to stage and from stage to screen is invisible producing a smooth continuous effect. It is an object of the invention to provide improved elements and arrangements thereof in a stage design and in a theater design for the purposes described which is inexpensive, dependable and fully effective in accomplishing its intended purposes.

The "Multex" stage design comprises a theatre stage and motion picture screen arrangement that allows the audience to experience continuous uninterrupted entertainment on screen and on stage with seamless transitions between stage to screen and screen to stage. The transition from stage to screen and from screen to stage occurs without any discontinuity. These seamless transitions allow the audience to remain continuously focused throughout the entire performance with no break in the action. The fading of the action on the screen and the lighting of the stage is done in such a manner that there is no perceptible discontinuity or interruption in the action viewed by the audience.

The theatre stage of the present invention includes an upper stage with an opening for raising and lowering scenes onto and off of the stage, and a lower preparation area for set design, dressing rooms and storage. The multi-transforming stage also includes a set transport mechanism that eases movement and storage of the sets on the theatre stage.

The large movie screen and the dome ceiling screen provides the audience with a sense of participation in the action. The coordination of the fading in and out of the action on the screen with the rising and dimming of the stage lights gives the audience the perception that the characters on screen have stepped out of the screen and onto the stage. One minute the audience is watching the screen, then the next minute the audience's focus is on the stage. With the "Multex" design, the audience can enjoy panoramic views, action sequences, and special effects and at the same time enjoy all the warmth and intimacy of live theater.

The "Multex" stage design is the primary component of a Multi-E theater. A Multi-E or Multi-Entertainment theater is a large modern theater with thousands of seats located on a main level in addition to several balcony areas. A Multi-E theater is a triangular shaped theater with three large screens positioned over a large stage area and a dome shaped ceiling that is also a movie screen. The three large screens have a slight curvature which is undetectable by the audience. The centrally disposed large screen is the main screen and can move both vertically and horizontally, while the other two large screens are laterally disposed and are stationary. The dome ceiling screen has a modular construction comprising a series of panels that when brought together form a ceiling above the audience. The Multi-E theatre surrounds the audience with entertainment.

The above noted and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 10:
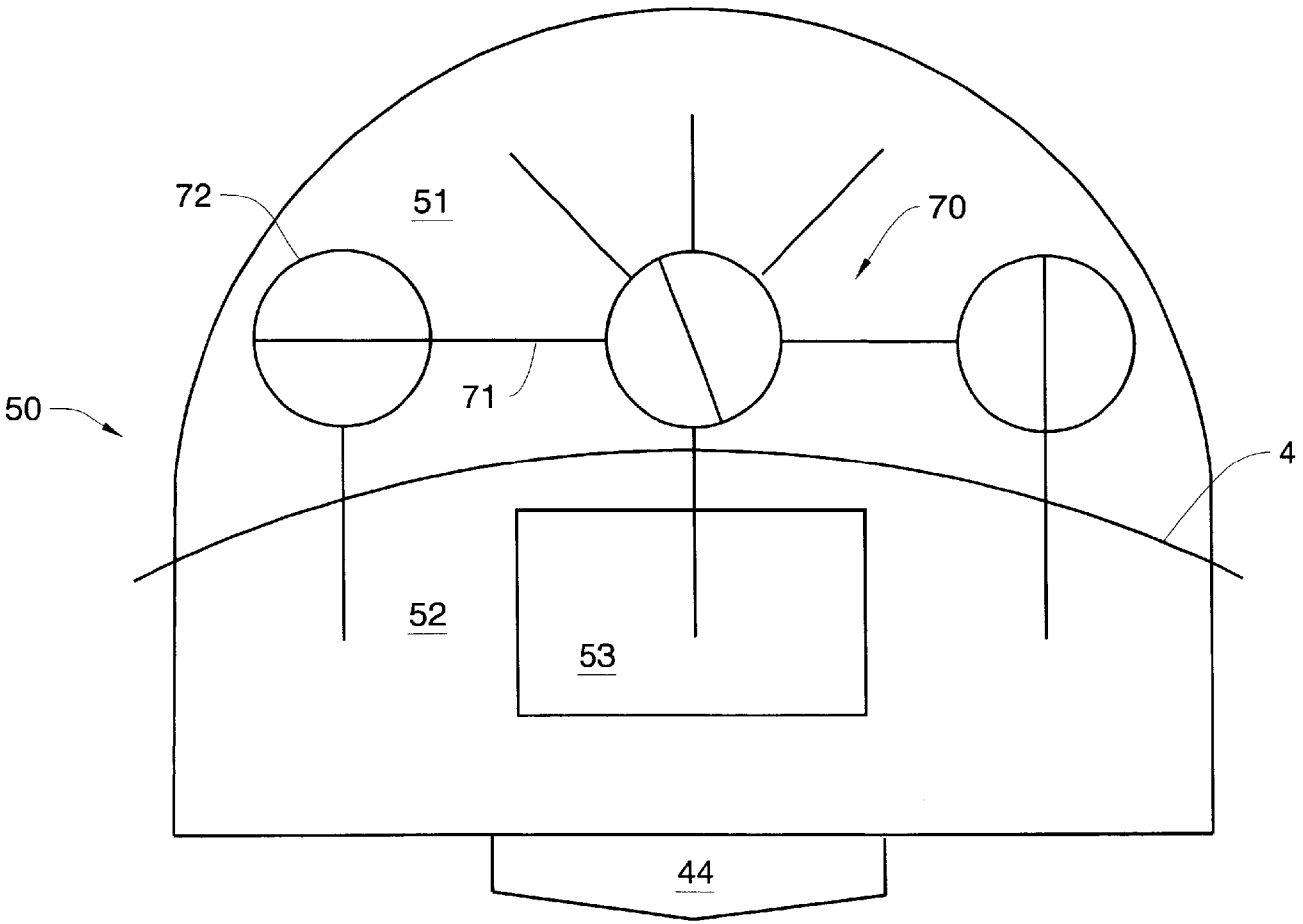
FIG. 10 depicts an overhead view of the preferred embodiment.

FIG. 10 depicts an overhead view of the preferred construction of the present invention. Included is an upper stage 50 that further comprises, a back stage 51, a fore stage 52 that has an upper stage opening 53 providing access to; a preparation area 55 (not shown in FIG. 10); a large motion picture screen 4; a set transport mechanism 70, and an audience viewing area 7 (not shown in FIG. 10). Both the large motion picture screen 4 and the upper stage 50 of the preferred construction are viewable from the audience viewing area 7. The back stage 51 and the preparation area 55 are out of sight from the audience viewing area 7. The depicted construction permits an integrated entertainment experience including motion picture and live theatre.

Figure 1:
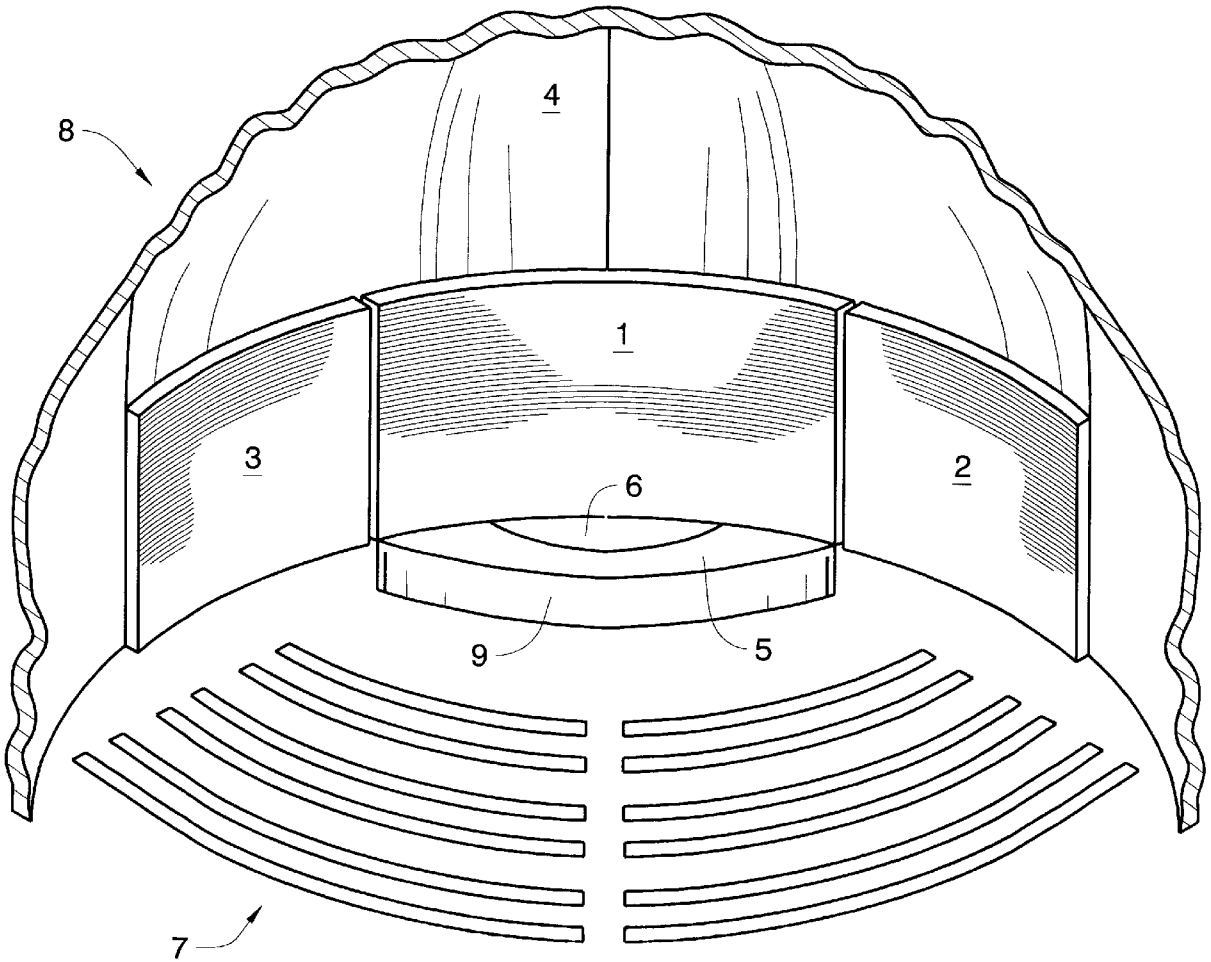
FIG. 1 is a perspective view of the front of the stage showing the movable main center screen, the stationary right and left screens, and the anterior portion of the dome ceiling screen according to the present invention.
Figure 9:
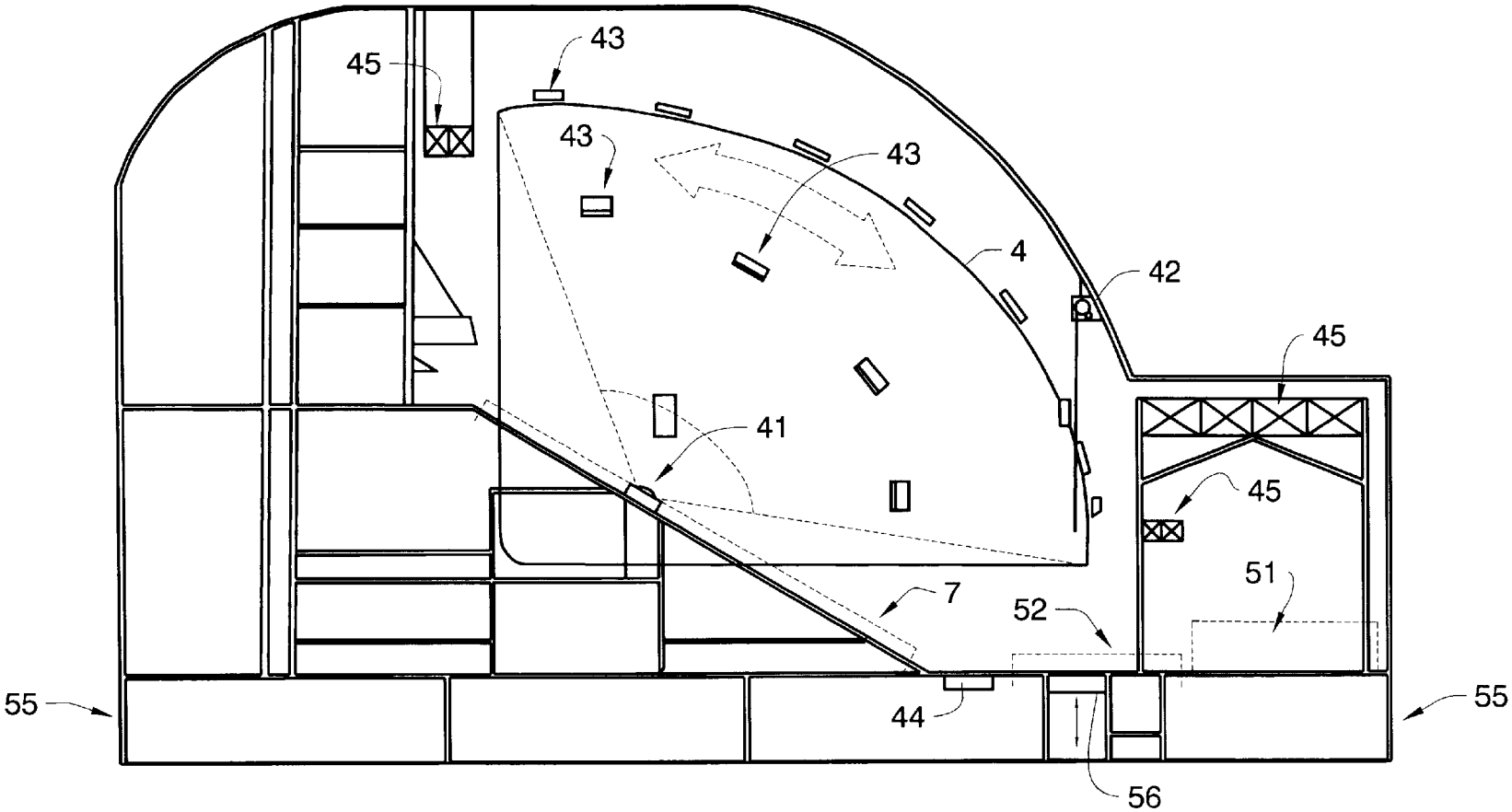
FIG. 9 depicts a side view of the preferred embodiment.

FIG. 9 depicts a cutaway side view of the preferred construction and illustrates desirable features and their relative positioning within the integrated theatre. During a performance, the audience's attention will be directed between the screen 4 and the upper stage 50. A winch 42 provides preferred manner of maneuvering the screen 4 vertically into an ergonomic arrangement for the audience. Alternatively, additional viewing screens (1,2,3), such as depicted in FIG. 1, can be maneuvered onto the stage 5 to extend the screen 4. The lower preparation area 55 is accessible from below the upper stage 50 and includes typical theatre preparation areas such as set fabrication and dressing rooms. An elevator 56 is the preferred mechanism providing the access from the lower preparation area 55. Alternatively, a ramp could also be used to provide access to the upper stage 50 from below.

Further illustrated in FIG. 9 are various features that enable a working multi-entertainment theatre. Included in the theatre construction are; a motion picture projector 41, at least one lighting rig 45, a plurality of speakers 43 distributed around the theatre, and an orchestra pit 44 in front of the stage 50. Finally, other areas such as storage, office space, control rooms, a lobby are also included.

The sets are transferred to the upper stage 50 through the upper stage opening 53. The preferred manner of transferring sets between the upper stage 50 and the preparation area 55 is by an elevator 56. Still, the inventor contemplates that ramps could also be used to transfer sets to the upper stage 50. Once the sets are on the upper stage 50, the sets can be shuttled around the fore stage 52 and the back stage 51 using the set transport mechanism 70. See FIG. 10. The preferred set transport mechanism comprises a modular track 71 that can be assembled to any configuration needed for a particular performance and that can further include at least one set turntable 72. Sets are coupled to the modular track 71 on wheels adapted for the track 71. During a performance, the at least one set turntable 72 permits a convenient means of shuttling, storing, and quickly accessing sets on sections of modular track 71.

Figure 2:
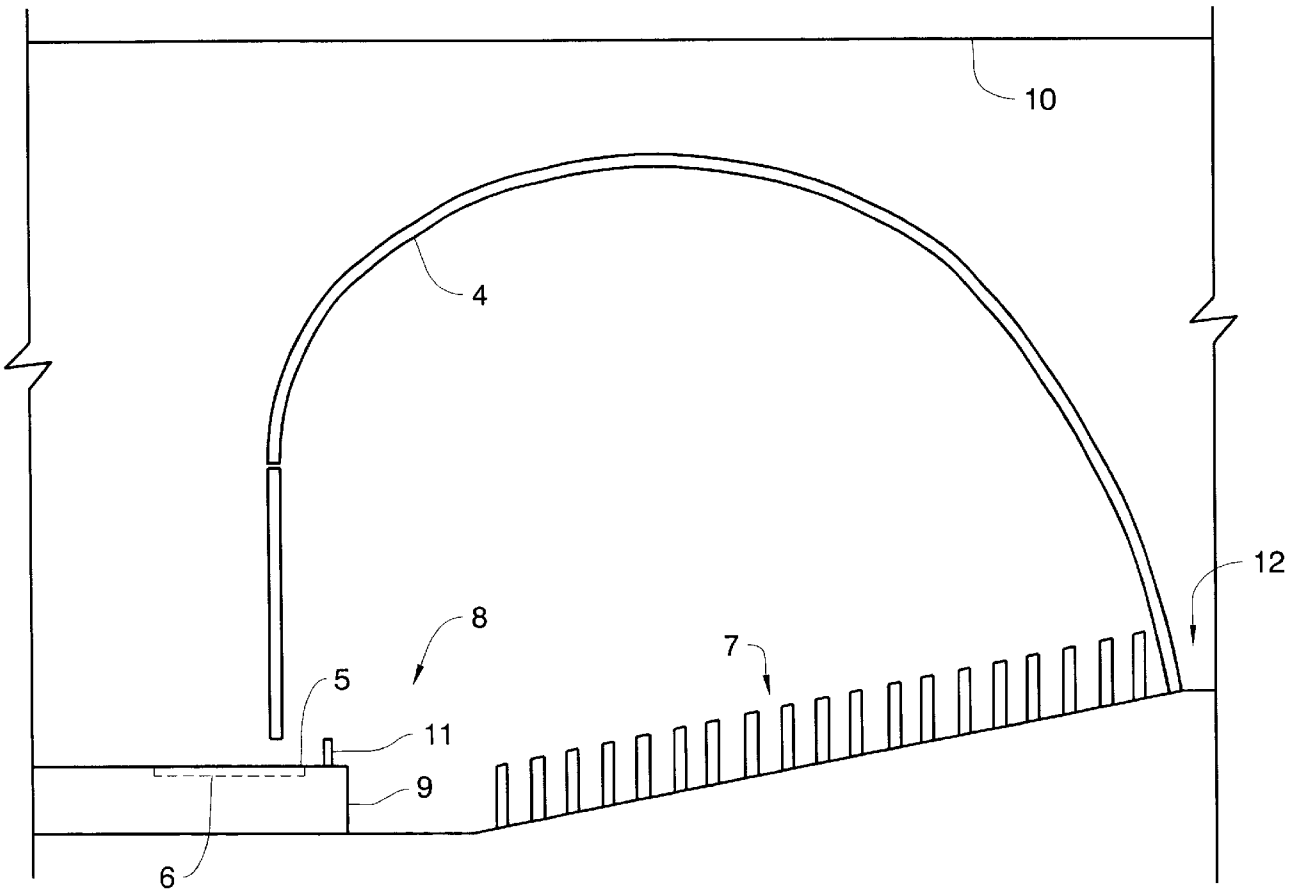
FIG. 2 is a cross-sectional view of screen-to-stage and stage-to-screen transition theatre showing the spatial arrangement and relationship between the main center screen, the dome ceiling screen, and the ceiling of the theatre according to the present invention.
Figure 3:
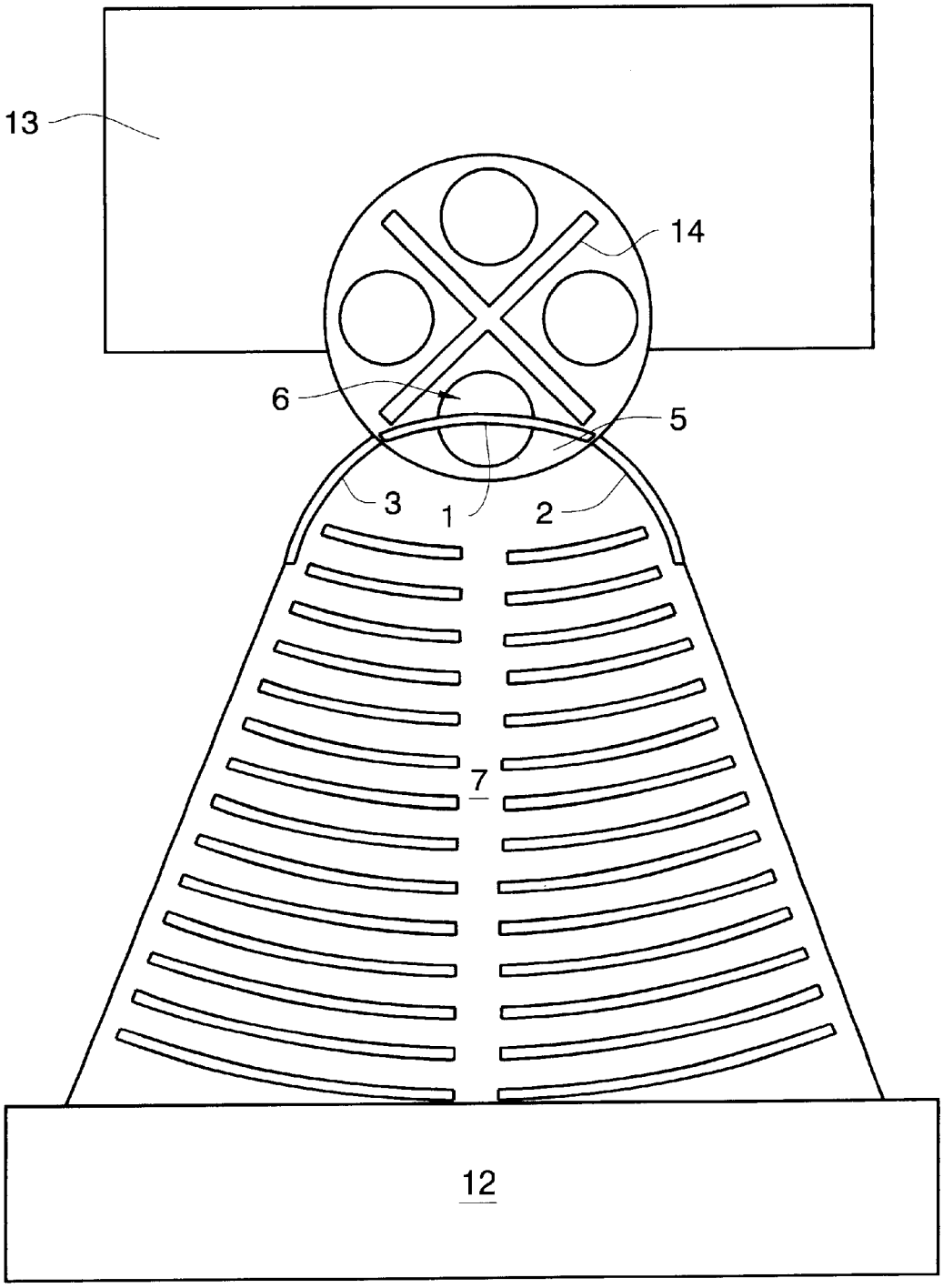
FIG. 3 is an aerial view of stage, movie screens, seating area, and entrance area of theatre according to the present invention.
Figure 4:
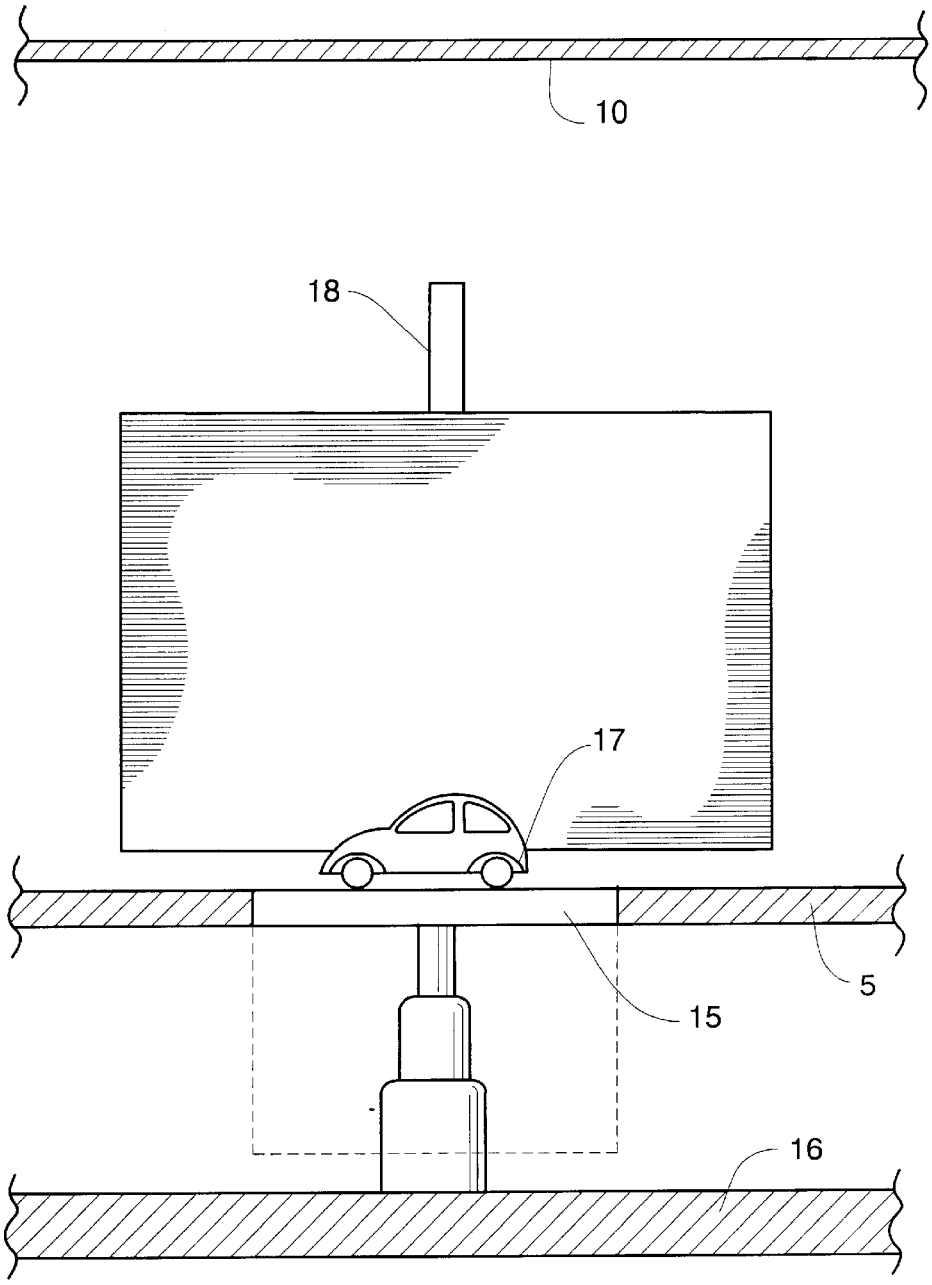
FIG. 4 is a front view of the stage showing the center main screen, the vertically movable stage platform, the upper stage, and the lower stage according to the present invention.

FIGS. 1–8 depict an alternative, more elaborate, construction of the present invention. Referring to FIG. 1 which is a perspective view of a front stage area 8 shows quarter sections of an upper rotating stage 5 that is visible to the audience and a circular opening 6 into which a stage platform 15 that is used to transport props to and from a lower rotating stage 16 is introduced, a movable main center screen 1, the two lateral stationary screens (2,3), and the anterior portion of the large motion picture screen 4 that is dome shaped in this embodiment. FIG. 1 depicts the configuration of the Multi-E theatre during the movie portion of the performance. The performers on stage 5 exist either stage left or stage right and the props on the circular stage platform 15 are lowered from the upper stage 5 to the lower stage 16 (FIG. 4). The main centrally disposed large format movie screen 1 is lowered and the modular components or panels 10 that make up the dome shaped screen 4 are brought together to form a dome. The movie portion of the performance is projected on the centrally disposed main screen 4, the two laterally disposed screens (2,3), and the dome screen 4. The lateral screens (2,3) comprise a right screen 2 (viewer's right) and a left screen 3 (viewer's left). Both lateral screens (2,3) are stationary or fixed. The audience seated in the viewing area 7 is surrounded with sights and sounds.

A cross-sectional view of the screen-to-stage and stage-to-screen seamless transition theatre showing the spatial arrangement and relationship between the front stage area 8, the main center screen 1, the dome screen 4, the viewing area 7, the entrance area 12 of the theatre, and the ceiling of the theatre 10 is shown in FIG. 2. The large format screens (1,2,3) are colossal in size ranging from 6–8 stories in height and from 11–12 stories in width. In this embodiment, the dome shaped screen 4 constitutes the ceiling, the lateral walls, and the posterior walls of the viewing area 7. When the dome screen 4 is closed, the dome screen 4 encloses the viewing area 7 and when the dome screen 4 is open, the lateral interior portions (not shown) of the building and the entrance area 12 of the theatre is visible to the audience.

The anterior portion of the dome screen 4 terminates at the top of the main center screen 1 and the two lateral screens (2,3). The height of the dome shaped screen can range from 12–14 stories with the height of the building that houses the theatre ranging from 16–18 stories. In a preferred embodiment, an elongated black mesh screen 11 is raised from beneath the front stage 9 and is disposed beneath the main center screen 1. The black mesh screen 11 serves to mask from the audience any activity occurring on stage during the movie portion of the performance.

FIG. 3 is an aerial view showing the structural arrangement and relationship between the partitioned upper circular rotating stage 5, the stationary portion of the upper stage 13, the stage movie screens (1,2,3), the seating area 7, and the entrance area 12 of the theatre. The stage partition 14 divides the upper circular rotating stage 5 into four equal quarter sections with only one quarter section of the upper rotating stage 5 being visible to the audience. The stage partition 14 does not extend to the edge of the upper rotating stage 5 because sufficient space must be provided between the partition 14 and the edge of the movable portion of the stage 5 so that the performers can readily exist either stage right or stage left. By removing the removable partition 14 located between any two quarter sections, a semi-circle or half section can be created.

Each quarter section of the upper rotating stage 5 has a circular opening 6 centrally disposed within the quarter section into which a vertically movable stage platform 15 is inserted. The stationary portion of the stage 13 is adjacent to the upper rotating stage 5 and constitutes the backstage area 13 of the stage (5,13) where the necessary perfunctory and ancillary activities required in live theatre are performed. The main center screen 1 is disposed anteriorly within the viewable quarter section above the anterior portion of the circular opening 6. The two lateral screens (2,3) begin at the edge of the upper rotating stage 5 and extend outwardly into the seating area 7 as depicted in FIG. 3. The main center screen 1 and the two lateral screens (2,3) are curved.

A front view of the stage showing the main center screen 1 with support rod 18, the vertically movable stage platform 16, the upper stage 5, and the lower stage 16 is depicted in FIG. 4. FIG. 4 shows how a prop 17, in this case, a vehicle 17, or a set design is conveyed from the lower rotating stage 16 to the upper rotating stage 5 using the vertically movable stage platform 15. During the stage-to-screen transition, the main center screen 1 is gradually lowered into place above the stage 5 while the stage lights are gradually turned off and the stage platform 15 with vehicle 17 is gradually lowered down to the lower stage 16. During a screen-to-stage transition, the main center screen 1 is gradually raised, and the stage platform 15 with prop 17 or set design is gradually raised from the lower rotating stage 16 and introduced into the circular opening 6 of the upper rotating stage 5. During both the stage-to-screen and the screen-to-stage transitions, the raising and the lowering of both the main center screen 1 and the stage platform 15 are coordinated with one another and with sound and the stage lights such that no transition is perceived by the audience, that is, one minute the performers are on stage and the next minute the performers are on screen.

Figure 5:
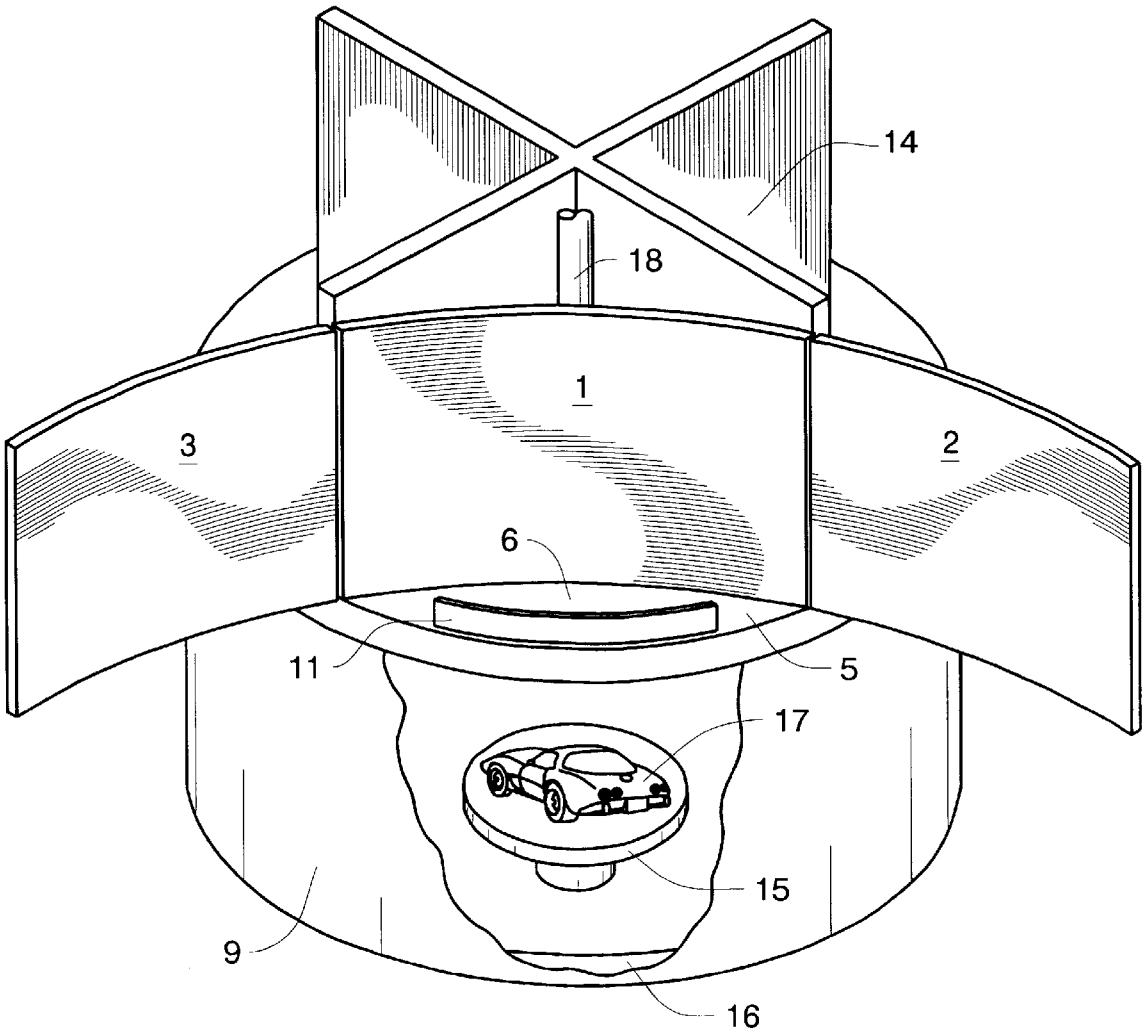
FIG. 5 is a perspective view of quarter section of rotating stage that is viewed by the audience showing the spatial arrangement and relationship between the stage partitions, the stage movie screens, the vertically movable stage platform, the front of the stage, the upper rotating stage, and the lower rotating stage according to the present invention.

FIG. 5 is a perspective view of the quarter section of the rotating stage 5 that is viewable by the audience showing the spatial and structural arrangement and relationship between the stage partition 14, the stage movie screens (1,2,3), the vertically movable stage platform 15, the front of the stage 9, the upper rotating stage 5, and the lower rotating stage 16. The anterior portion of the dome screen 4 has been removed to reveal the stage partition 14 behind the main center screen 1 and a portion of the front of the stage 9 has been cut away to reveal the lower rotating stage 16 and the lowered stage platform 15 which are both hidden from the audience's view.

Figure 6:
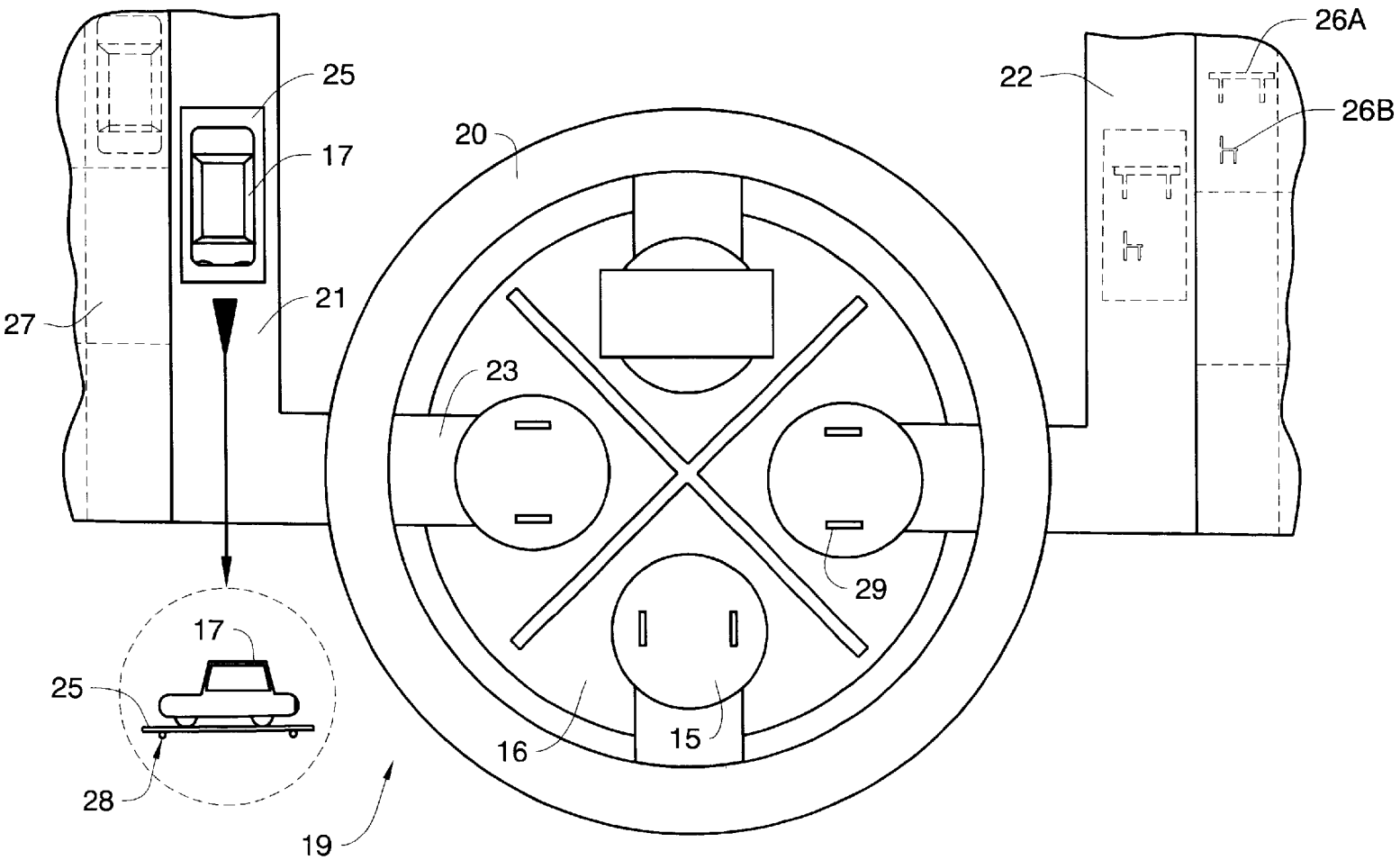
FIG. 6 is a top view of the lower stage showing the locations of the prop rooms and the conveyer system that transports props using a transport platform, shown in an elevational view inset, from the prop rooms to the vertically movable stage platform according to the present invention.

A top view of the lower stage area 19 is depicted in FIG. 6 which shows the locations of the rooms 27 for props 17 or set design (26*a*,26*b*), and, the conveyer system (20,21,22,23) that transports props on a transport platform 25 from the prop rooms 27 to the vertically movable stage platform 15. A prop 17 or a set design (26*a*,26*b*) from a prop room 27 is placed on a transport platform 25 having wheels 28 (inset in elevational view). The dimensions of the transport platform 25 vary depending upon the specific needs of the production but as an illustrative example, the transport platform 25 is 40 ft in length and 15 ft in width. The transport platform 25 with prop 17 is rolled onto a conveyer belt (21,22) adjacent the prop rooms 27 and transported by the conveyer belt (21,22) to a second circular conveyer belt 20 that surrounds the lower rotating stage 16. The circular conveyer belt 20 moves in either a clockwise or counterclockwise direction depending upon the specific needs of the production. Using the circular conveyer belt 20, the transport platform 25 with prop 17 is transported to the front a stage platform 15. The transport platform 25 is moved from the circular conveyer belt 20 onto the stage platform 15 via a third conveyer belt 23 disposed directly in front of the stage platform 15. The transport platform is locked into place on the stage platform 15 using a pair of rails 29 located on the stage platform 15 so that transport platform 25 will not move when the stage platform 15 rises from the level of the lower stage 16 to the level of the upper stage 5. The prop 17 is then taken off of the transport platform 25 and placed onto the upper stage 5. The reverse procedure is used to remove a prop 17 from the upper stage and returning the prop 17 to the prop room 27.

Figure 7:
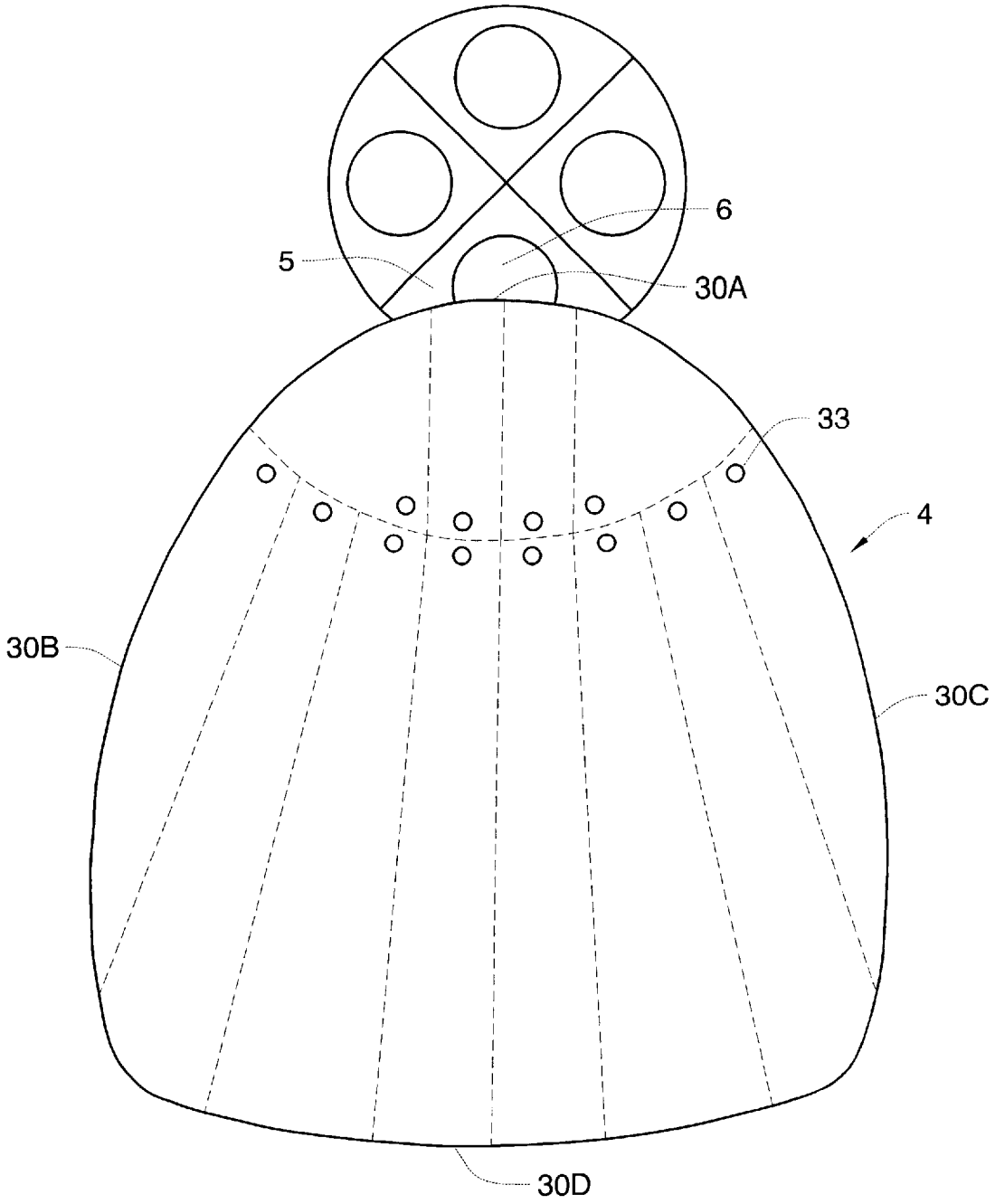
FIG. 7 is an overhead view of the upper surface of the dome ceiling screen when closed showing the modular arrangement of the screen and the location of the anterior portion of the closed dome ceiling screen over the audience viewable quarter section of the upper circular rotating stage according to the present invention.
Figure 8:
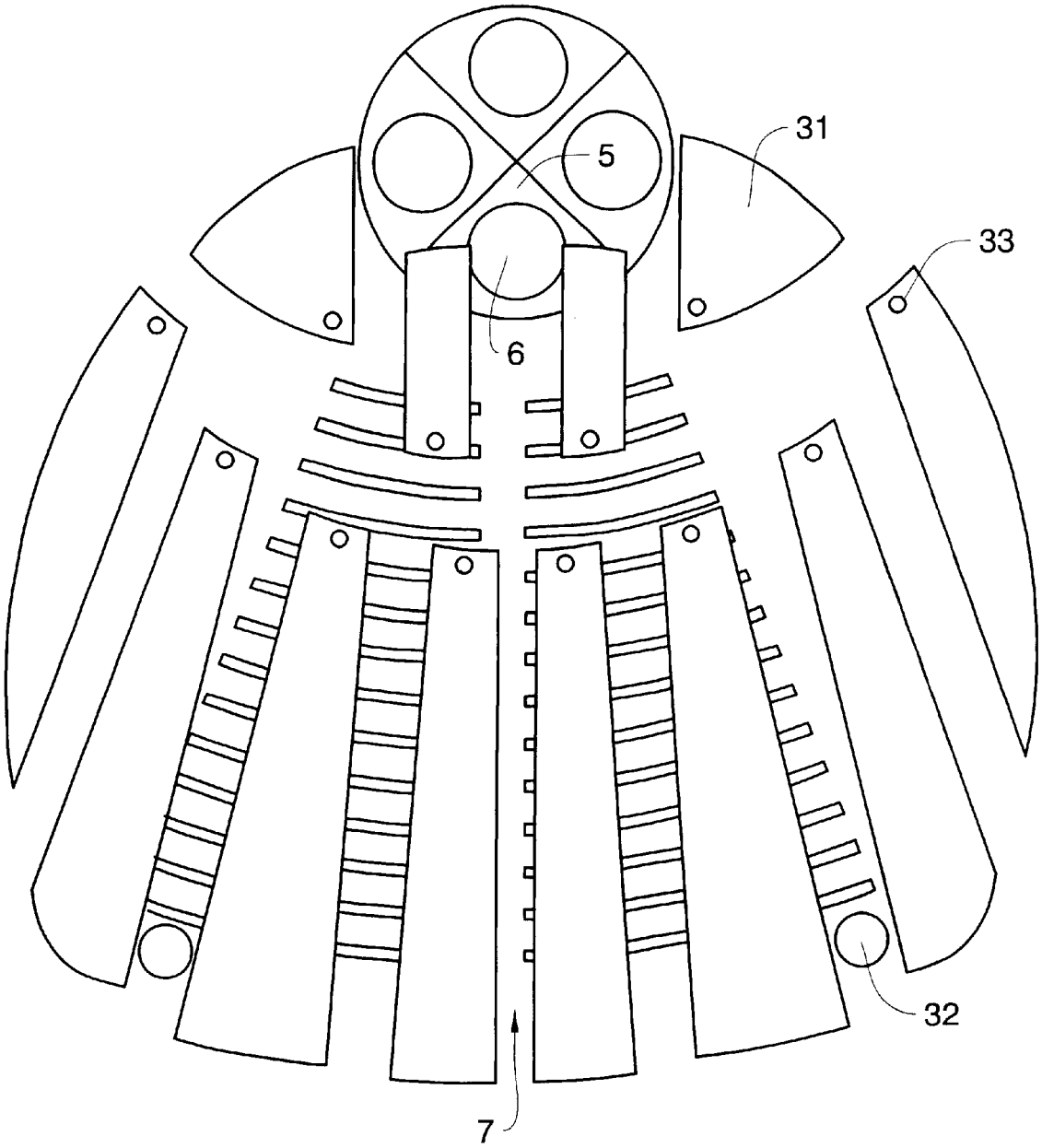
FIG. 8 is a top view of the upper surface of the dome ceiling screen when open showing the individual panels of the dome ceiling screen according to the present invention.

FIGS. 7 and 8, respectively, show top views of a closed dome screen 4 and an open dome screen 4. Referring to FIG. 7 which depicts a top view of the exterior surface of the dome screen 4 when closed showing the modular arrangement of the dome screen 4 and the location of the anterior portion of the closed dome screen above the audience viewable quarter section of the upper circular rotating stage 5. FIG. 7 shows the anterior border 30*a,* the posterior border 30*d,* and the lateral borders (30*b*,30*c*) that form the perimeter of the dome screen 4 as viewed from above the dome screen 4 looking downward. Referring to FIG. 8 which depicts a top view of the exterior surface of the dome screen 4 when the dome screen 4 is open showing the individual panels that make up the dome screen 4. Each panel 31 of the dome screen 4 is supported and moved using a support rod 33 that extends from the panel 4 to a support and movement means that is disposed within the building. Dispersed throughout the theatre are trap doors 32 and vertical transport means that allow the performers to readily interact with the audience.

The large format film stage screens (1,2,3) of the present invention are colossal in size with the size of the screens (1,2,3) being three times or more the size of a standard motion picture screen. The large format film main center screen 1 and the circular stage platform are hydraulically lowered and raised.

The entire upper stage 5 of the multi-transforming stage system of the present invention is set on top of a rotational means (not shown) that is automated and that can rotate the upper stage 5 at various velocities. The rotating upper stage 5 is set around stationary backstage platform 13. The lower stage 16 has a translational and rotational conveyor system (20,21,22,23) that serves as a feeding unit for the upper stage 5. The main center screen 1 is not only lifted up but is also moved back and away from its viewing location. The main center screen 1 can be moved both vertically and horizontally and as a result, the main center screen 1 can be gradually withdrawn at an angle. Furthermore, the entire building that houses the Multi-E theatre is capable of rotation.

This union between live theatre and motion pictures is not simply a marriage of convenience but a truly innovative entertainment extravaganza that surrounds the audience with non-stop, continuous entertainment that captivates and even intoxicates the audience. The multi-entertainment method and system of the present invention uses state-of-the-art mechanical and hydraulic systems to implement this innovative multiple entertainment. The activities of multi-entertainment are fully automated with all operational activities and devices (screens, lights, sound, and all stage movement) synchronized and coordinated to produce a performance free of distracting interruptions and discontinuities thereby providing the audience with an unprecedented and unparalleled entertainment experience that combines the best of Hollywood and the best of Broadway. The "Multex" stage design of the present invention is a major evolutionary advance in entertainment. It should be understood by those skilled in the art that various modifications and adaptations of the present invention as well as alternative embodiments of the present invention may be contemplated, for example, the shape of the stage platform, the opening in the stage, and the stage screens can be changed to accommodate the specific needs of the theatrical production.

The preferred embodiments of the present invention disclosed herein are intended to be illustrative only and are not intended to limit the scope of the invention. It is to be understood that the present invention is not limited to the embodiments described above, but encompasses any and all embodiments within the scope of the following claims.

I claim:

1. A multiple entertainment theatre construction, comprising:

A. an upper stage and a lower stage whereby said upper stage is accessible from said lower stage by an upper stage opening;

B. at least one large dome shaped screen positioned above said upper stage; and

C. a set transport mechanism.

2. The multiple entertainment theatre construction in claim 1 wherein said at least one large screen is curved.

3. The multiple entertainment theatre construction in claim 1 wherein said at least one large screen is movable.

4. The multiple entertainment theatre construction according to claim 1, wherein said dome screen has a modular construction comprising a collection of panels.

5. The multiple entertainment construction in claim 1 further comprising at least one stage motion picture screen positioned upon the upper stage.

6. The multiple entertainment construction in claim 1 further comprising an audience viewing area.

7. A method of entertaining that produces seamless screen-to-stage and stage-to-screen transitions for a combination theatrical and motion picture production comprising:

A. performing live theatre on a theatre stage before an audience;

B. dimming at least one bank of theatre lights;

C. maneuvering a dome shaped motion picture screen into place before said audience;

D. projecting a motion picture onto said motion picture screen; and

E. transitioning between said performance of live theatre and said motion picture projection until said combination theatrical and motion picture production is finished.

8. The method of entertaining in claim 7 further comprising the step of maneuvering at least one set onto the theatre stage during the transitioning between said performance of live theatre and said motion picture projection.

9. A multiple entertainment theatre construction comprising:

A. a large stage and a large seat capacity main level with several balcony areas whereby said theater has a triangular shape and said large stage comprises a rotating upper circular stage, a rotating lower circular stage, and a stationary backstage area, whereby said rotating upper circular stage is partitioned into four large equal quarter sectors with each of said quarter sectors having a circular opening;

B. a quarter sector of said four large quarter sectors having a large centrally disposed screen above said quarter sector and two large laterally disposed screens adjacent said quarter sector, whereby said large centrally disposed screen is movable and said large laterally disposed screens are fixed;

C. said rotating lower circular stage having four equally spaced vertically movable circular platforms; and D. a modular dome shaped screen that forms the interior ceiling and walls of said theatre.

10. A multiple entertainment theatre construction, comprising:

A. a curved dome shaped motion picture screen coupled to an inner wall of said theatre construction;

B. a theatre stage disposed beneath said curved motion picture screen and coupled to the floor of said theatre construction;

C. a set transport system coupled to said theatre stage; and

D. a plurality of audience seats coupled to said theatre construction and disposed anteriorly to said curved motion picture screen and said theatre stage.

11. The multiple entertainment theatre construction of claim 10 wherein said theatre stage comprises further construction, including;

A. a first stage, viewable by an audience, coupled to;

B. a second stage, out of view from the audience.

12. The multiple entertainment theatre construction of claim 11 wherein said set transport system comprises an elevator adapted to provide transport between said first stage and said second stage.

13. The multiple entertainment theatre construction of claim 10 wherein said set transport system further comprises a modular track system that is coupled to said theatre stage.

14. The multiple entertainment theatre construction of claim 13 wherein said set transport system further comprises at least one turntable coupled to at least two sections of said modular track system.

* * * * *